US005546743A

United States Patent [19]

Conner

[11] Patent Number: 5,546,743

[45] Date of Patent: Aug. 20, 1996

3

[54] ELECTRON PROPULSION UNIT

[76] Inventor: Paul H. Conner, 4157 Waterway Dr., Dumfries, Va. 22026

[21] Appl. No.: 352,237

[22] Filed: Dec. 8, 1994

[51] Int. Cl.[6] ..... H05H 5/00

[52] U.S. Cl. ..... 60/202; 315/505

[58] Field of Search ..... 60/202, 203.1; 313/310, 359.1; 315/505

[56] References Cited

U.S. PATENT DOCUMENTS

| | | | |
|---|---|---|---|
| 2,997,013 | 8/1961 | Rice . | |
| 3,102,384 | 9/1963 | Bennett . | |
| 3,114,517 | 12/1963 | Brown . | |
| 3,155,858 | 11/1964 | Lary et al. . | |
| 3,157,988 | 11/1964 | Schultz . | |
| 3,264,568 | 8/1966 | Goerz et al. | 315/505 |
| 3,403,346 | 9/1968 | Giordano . | |
| 3,542,316 | 11/1970 | Hart . | |
| 3,769,599 | 10/1973 | Leboutet et al. . | |
| 3,818,700 | 6/1974 | Kantrowitz et al. . | |
| 4,287,488 | 9/1981 | Brau et al. | 331/94.5 |
| 4,383,180 | 5/1983 | Turner . | |
| 4,392,080 | 7/1983 | Maschke . | |
| 4,485,346 | 11/1984 | Swenson et al. | 315/505 |
| 4,490,648 | 12/1984 | Lancaster | 315/505 |
| 4,730,166 | 3/1988 | Birx et al. . | |
| 4,912,421 | 3/1990 | Anderson . | |
| 5,021,741 | 6/1991 | Kornely, Jr. et al. . | |
| 5,280,252 | 1/1994 | Inoue et al. . | |
| 5,430,359 | 7/1995 | Swenson et al. | 315/505 |

FOREIGN PATENT DOCUMENTS

| | | |
|---|---|---|
| 27700 | 1/1990 | Japan . |
| 294100 | 10/1992 | Japan . |
| 290997 | 11/1993 | Japan . |
| 337077 | 12/1974 | U.S.S.R. . |
| 322139 | 4/1975 | U.S.S.R. . |

OTHER PUBLICATIONS

Fazio et al—IEEE Transactions on Nuclear Science, vol. NS-26, No. 3, Jun. 1979, pp. 3018-3020.

Hansborough et al—IEEE Transactions on Nuclear Science, vol. NS-28, No. 2, Apr. 1981, p. 1511.

Heppenheimer, T. A.; "Free-Electron Lasers;" *Popular Science*, Nov. 1987; pp. 63-67.

Houts, Michael; "Thermionic Space Fission Power Supplies;" Florida Institute of Technology, Melbourne, 19 May 1993.

*Primary Examiner*—Louis J. Casaregola

*Attorney, Agent, or Firm*—Clyde I. Coughenour

[57] ABSTRACT

An electron acceleration device uses thermionic fission cells, an electromagnetic scoop coil, and/or microwaves for power. A power control junction and electron injector control and feed free electrons in packets into the acceleration components that consist of a series of either induction module units, or radio-frequency linacs module units, having quadrapole magnet units in series between the induction module units or RF linac units. The RF linac and quadrapole series are surrounded by a Klystron series. At the high speed electron exit from the device, deflector plates control the exit path of the electrons to direct the course of a craft or electrons to a work area.

17 Claims, 1 Drawing Sheet

ELECTRON PROPULSION UNIT

BACKGROUND OF THE INVENTION

1. Field of the Invention

The invention is directed to an electron propulsion engine or unit that takes either free or electrically generated electrons and accelerates them for the purpose of creating a force by electromagnetic fields for use as either a propulsion means for craft or for performing work.

2. Description of the Related Art

Electron beams have found wide use as a heat source for heat treatment, furnaces, welding, etc., and have been used for sterilization, medical irradiation, pattern generation or scribing, bonding adhesives, vapor deposition, etching or engraving, recording, excavation, power transmission, research, etc.

It has been suggested that particles be used as a propulsion means for space craft, examples being: W. A. Rice U.S. Pat. No. 2,997,013, issued Aug. 22, 1961, and E. C. Lary et al U.S. Pat. No. 3,155,858, issued Nov. 3, 1964, and R. D. Schultz U.S. Pat. No. 3,157,988 issued Nov. 24, 1964. It has been proposed that the particles to be accelerated be collected from those available in space: W. H.BENNETT U.S. Pat. No. 3,102,384, issued Sep. 3, 1963. To reduce the weight of craft, it has also been proposed that energy be beamed in from a distant point: W. C. Brown U.S. Patent Nos. 3,114,517, issued Dec. 17, 1963; H. M. Hart U.S. Pat. No. 3,542,316, issued Nov. 24, 1970 and, A. R. Kantrowitz et al. U.S. Pat. No. 3,818,700 issued Jun. 25, 1974

The acceleration of charged particles by linear accelerators is common with various arrangements being used. The individual components that have been used include quadrapole magnets, Klystrons, radio-frequency Linacs, etc., in various combinations. As examples,H. P. Leboutet et al U.S. Pat. No. 3,769,599, issued Oct. 30, 1973; A. W. Maschke U.S. Pat. No. 4,392,080, issued Jul. 5, 1983; D. A. Swenson et al U.S. Pat. No. 4,485,346, issued Nov. 27, 1984; D. L. Birx et al U.S. Pat. No. 4,730,166, issued Mar. 8, 1988; D. A. Anderson U.S. Pat. No. 4,912,421, issued Mar. 27, 1990; M. G. Kornely et al U.S. Pat. No. 5,021,741, issued Jun. 4, 1991; and K. Inoue et al U.S. Pat. No. 5,280,252, issued Jan. 18, 1994, are cited as examples.

SUMMARY OF THE INVENTION

Because of the small mass of electrons, they have not been seriously considered as a propellant. Electrons can be used alone, or in combination, for propulsion. Electron propulsion is considered to be a unique principle of propulsion in which the acceleration force of free-electrons, passing through an electromagnetic field, are applied to the mass of a craft or vessel to produce acceleration of the craft. As craft are propelled through space, they encounter particles, some of which are referred to as a solar wind. It has been noted that prior electrostatic scoop designs such as those addressed by Mallove and Matloff in "*THE STARFLIGHT HANDBOOK*" published in 1989 do not absorb electrons or are not concerned with absorbing electrons. During the design of spacecraft, because of the theoretical electron drag, it has been taken into consideration. Because of the availability of electricity, many if not most of the electrons needed to feed an electron propulsion system can be provided by use of these free electrons found in space. The present invention can also generate electrons by the more conventional thermionic heat or fission cells. An injector can be used for electron to free-electron conversion. As an engine, electron propulsion is capable of producing exceptional and sustainable thrust to propel a vessel to a very high velocity. In the form of an unmanned missile, this engine is capable of propelling an object that is capable of intercepting and releasing a large amount of relativistic kinetic energy to destroy, deflect, or obliterate an object such as another missile or earth threatening comet or asteroid, through a high velocity impact. Such a missile could possibly be used cooperatively or in conjunction with a thermonuclear device. It can alternately be used to propel or assist propulsion of air, land or sea based vehicles that are either manned or controlled remotely. The control could possibly be by laser data-packet transmissions, now under investigation. The propulsion unit, in a stationary position, can generate highly accelerated electrons as the source of electrons for the various prior art uses, such as drilling, mining, heating, etching, etc., set forth above. The propulsion unit includes a linear accelerator that can be of the induction type, or can be a Klystron series surrounding alternating radio frequency Linac modules, and quadrapole magnets in series. The electrons are preferably provided by an electromagnetic scoop coil and/or thermionic fission cells fed through a power controlled junction and electron injector. An alternate power source can be microwaves beamed in from a distant source.

DESCRIPTION OF THE PREFERRED EMBODIMENTS

Figure 1:
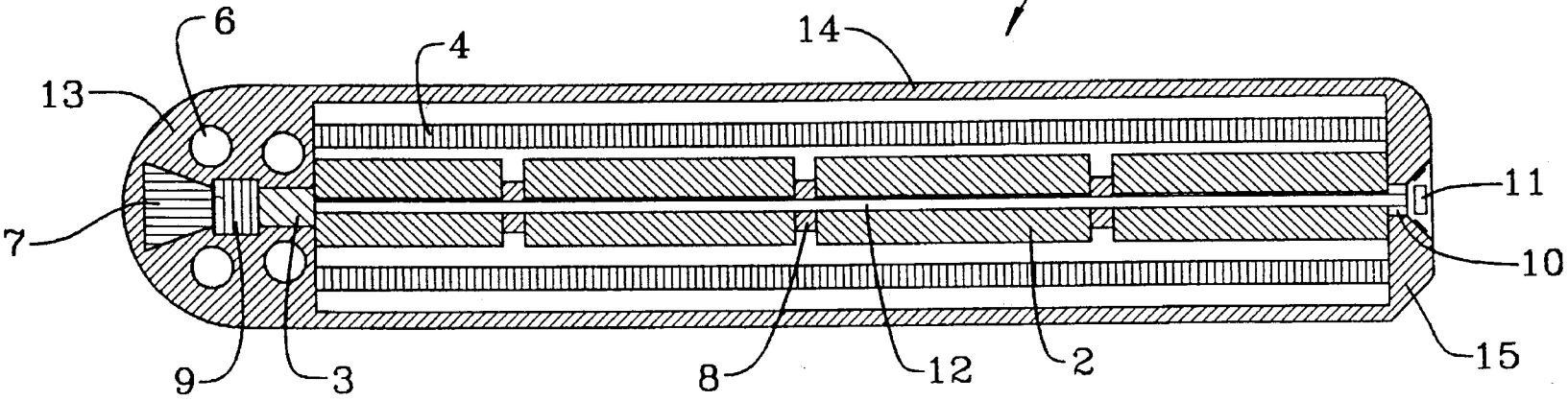
FIG. 1 is a sectional view of the electron engine or unit using an RF Linac linear accelerator.

The invention of FIG. 1 relates to an electron propulsion unit or engine 1. The unit includes a front or nose end 13 that is shown housing an electromagnetic scoop coil 7, a power control junction 9, several thermionic fission cells 6, and an electron injector 3. The main body 14 of the propulsion unit contains a Klystron series 4 surrounding radio-frequency accelerating modules (RF Linac modules) 2, that have quadrapole magnets 8 between the RF linac modules. Within the RF linac and quadrapole units there is an electron path 12 that extends from, or begins at, the electron injector 3 and extends to an exhaust port 10 at the rear or tail end of the unit. The rear or tail end section 15 of the propulsion unit 1 houses the electron exhaust port 10 and electron deflection plates 11. The power sources for the various elements can be provided, individually or in combination, from a thermionic fission generator, a beamed-in microwave, and an electromagnetic scoop.

Figure 2:
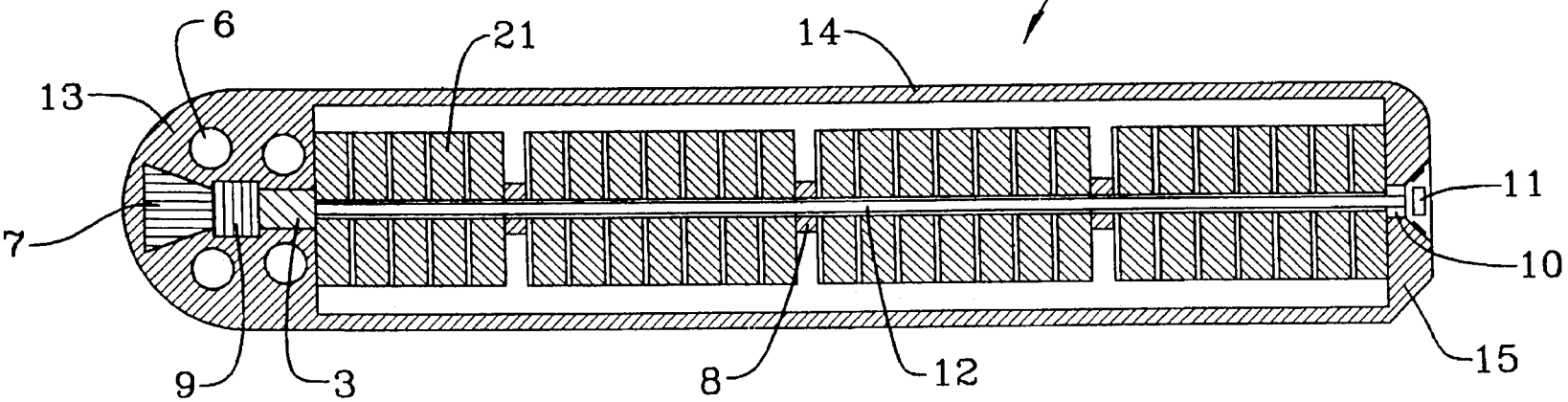
FIG. 2 is a sectional view of the electron engine or unit using an induction linear accelerator.

The invention of FIG. 2 is to an electron propulsion unit or engine 20 similar to that shown in FIG. 1. In FIG. 2, the linear accelerator is shown as an induction linear accelerator with induction modules 21 shown in series with Quadrapole magnets 8 positioned between the modules. The other elements are the same as those shown and described with respect to FIG. 1, and are given the same numerical designations.

Theoretical Concept

In accordance with Sir Isaac Newton's second law of motion, if an electron's finite mass of about $9.1\times10^{-31}$ kg is to be accelerated, it will require a force. Sir Isaac Newton's third law of motion states that forces must always exist in pairs which are equal and opposite in magnitude.

Although, independently, one electron is only capable of producing a very minute force, in groups they can produce a large force, due to the ability to rapidly accelerate them. The acceleration force (F) of an electrically charged particle, such as an electron, is equal to the particle's charge (q) multiplied by the strength of the electric field (E) through which it is passing. With the given charge of an electron being $q=1.6\times10^{-19}C$, and the electric field through which it passes being $E=9.8\times10^{6}N/C$, the force of a single electron is essentially $F_{elec}=qE=1.6\times10^{-12}N$, (where C is the unit of electrons in Coulombs and N is the unit of force in Newtons). The resulting acceleration is calculated by employing relativistic mechanics.

$$\gamma=\frac{1}{\sqrt{1-\frac{v^2}{c^2}}} \qquad a=\frac{qE}{\gamma^3 m}$$

Where γ (gamma) is a variable that can change with v (velocity), c is the speed of light, m is mass or in units m is meters and s is seconds. With an initial velocity of 0, the acceleration of the electron becomes:

$$\begin{aligned} a_{elec} &= \frac{qE}{\gamma^3 m_e}=\frac{1.6\times10^{-12}N}{(1)^3\,(9.1\times10^{-31}\text{ kg})} \\ &= 1.76\times10^{18}\text{ m/s}^2 \end{aligned}$$

This force, which can be considered insignificant, does notably produce a substantial acceleration. When the charge or number of electrons is increased, for example to the number that equals one Coulomb ($6.25\times10^{18}$ electrons):

$$F_{elec}=qE=(1C)(9.8\times10^{6}N/C)=9.8\times10^{6}N$$

By exchanging the electron mass with the predicted mass of a free-electron spacecraft, arbitrarily taken to be $1\times10^{6}$ kg, the resulting acceleration of the spacecraft is:

$$\begin{aligned} a_{craft} &= \frac{qE}{\gamma^3 m_{craft}}=\frac{9.8\times10^{6}N}{(1)^3\,(1\times10^{6}\text{ kg})} \\ &= 9.8\text{ m/s}^2 \end{aligned}$$

This one "G" acceleration is the ideal desired rate of travel for an interplanetary or interstellar vehicle, as it simulates the gravitational effects of Earth, although, within the constraints of relativistic mechanics, a constant force will not provide a constant acceleration. As the craft reaches greater velocities, the force will have to be increased. The following shows the force required to sustain a one "G" acceleration at a velocity of 0.99*c* or 99% of the speed of light. From the equation with $v=2.97\times10^{8}$ and $c=3\times10^{8}$, gamma will be equal to 7.1.

To maintain an acceleration of 1 "G" or 9.8 $m/s^2$:

$$a_{craft}=9.8\text{ m/s}^2=\frac{(q)\,(9.8\times10^{6}\,N/C)}{(\gamma^3)\,(1\times10^{6}\text{ kg})}$$

$$q/\gamma^3=1 \text{ so } q=\gamma^{3=(7.1)^3}=358$$

$$F_{elec}=qE=(358C)(9.8\times10^{6}N/C)=3.5\times10^{9}N$$

Either the electric field or the total charge, as in the case above, can be increased in magnitude to compensate for an increasing relative mass.

Mechanical Concept

The mechanical concept for Electron Propulsion results from a combination of cold-war and post cold-war technology. As an example, SDI or the Strategic Defence Initiative has developed very high-power free-electron radio frequency linear accelerators. They can not only produce a more powerful free-electron beam, but can do it with a relatively small apparatus.

Thermionic converters or fission cells 6 are on-board sources of power for the components in the engine. The thermionic converter is a power source that functions essentially as an electric generator. They are static energy devices that "boil" electrons from a hot tungsten emitter surface across a small interelectrode gap to a cooler trilayer niobium-alumina-niobium collector surface. Any heat source can be used to power the converter. Fission, however, is considered the most practical for space systems. The thermionic fission reactor is usually fueled by 96% enriched U-235, and uses NaK as a coolant. This power system has a relatively low mass and a high power output. Units were available, as of mid-1993, with a full-power life of 7–10 years.

A source of supplementary electrons can be provided by an electromagnetic scoop coil 7, which will take advantage of the interstellar flux. The interstellar flux can be the "solar wind" or geomagnetic effects. The scoop coil 7 collects electrons from the ionic medium of space. The nose section is positively charged, by removing electrons from the nose section 13 of the propulsion unit 1 for injection into the accelerator, making it an electrified electron collector surface. Free electrons are collected on the nose section from the surrounding environment, and to some degree from the engine hull 14, for use in the propulsion unit. With the propulsion unit in motion, in an electron containing environment, the faster the propulsion unit travels, the more electrons there will be available for use in the propulsion unit during any given time period. As the force requirement increases for a greater velocity, because of the increasing mass due to the effects of relativity, a higher charge is necessary. This charge can, at least in part, be provided by the added number of electrons available due to increased speed. Alternatively, the electric field E strength can be increased.

The power control junction 9 is an electrical node that controls and coordinates the flow of current to and from all the electrical components. The electron injector 3 converts electric current into free-electron particles. It also bunches together electrons, in trillionths of a second, into tight packets which are sent into the accelerator. Such an injector can supply as many as one million electron bursts a second. The Klystron series 4 pumps energy into rows of small cavities which creates powerful, rapidly oscillating electric and magnetic fields in the radio-frequency linear accelerator. The radio-frequency linear accelerator modules, or RF Linacs 2, are used to accelerate the beams of free-electrons. Radio-frequency linac modules 2, or induction modules 21 accelerate the free-electron particles to produce a net force or high speed electrons for performing work. The RF Linac modules are surrounded by a series of Klystron tubes 4. These tubes with their magnetic fields cause the electrons to accelerate. Spaced between the RF Linac module units 2 are quadrapole magnets 8. Quadrapole magnets 8 control and vector the electron packets. These magnets keep the electron packets in small compact bundles as otherwise, due to the tendency of electrons to repel one another, they would be forced laterally and stray from the straight path 12. The high-speed electrons leave the propulsion unit 1 at an exhaust port 10 in the linear trajectory of the electron path 12 extending through the propulsion unit. Deflector plates 11 are provided at or adjacent to the exhaust port 10. The electron deflection plates vector the electron beam as it leaves the engine. These plates are electrically charged when it is desired that the trajectory of the electron beam be diverted from the linear path followed through the unit. If the propulsion unit is in motion, the plates can be used to control the direction the unit is moving in. If the unit is stationary, a randomly or continuously changing beam of electrons can be provided for any of the uses to which electron beams are put.

There are two preferred accelerator models that can be employed mechanically, the induction and RF Linac type units. Alternate or combined power sources can be used. They can use a power supply fueled by thermionic fission in a multi-cell configuration (individual reactor units vertically stacked together to produce a single electrical output). A second source can be a beamed in microwave thermionic power system. Internally, the necessary power is created by irradiating a pressurized water-filled core with microwaves to create the heat energy. This high-energy microwave signal can originate from an Earth-based facility, resulting in a lower overall spacecraft mass which lowers the force requirements for a given acceleration. Thermionic fission and thermionic microwave power and captured electrons can be used in combinations or all can be used together at the same time.

Since space is generally known to be about two degrees above absolute zero, in regions obscured from the solar illumination, space-cooled superconductivity may be introduced into the device. The induction modules 21, shown in FIG. 2 are preferred for use in a super conductivity system.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

I claim:

1. An electron accelerator including:

a thermionic fission cell for generating electricity;

an electron injector for converting electricity into free electrons;

a liner accelerator for accelerating said free electrons converted by said electron injector;

a linear electron path through said linear accelerator for acceleration of said electrons in a straight path.

2. An electron accelerator as set forth in claim 1 wherein:

said linear accelerator is an induction linear accelerator.

3. An electron accelerator as set forth in claim 1 wherein:

said linear accelerator includes a radio frequency Linac.

4. An electron accelerator as set forth in claim 1 wherein:

said linear accelerator is in the form of a series of acceleration modules;

a quadrapole magnet is positioned between said electron acceleration modules to control and vector said electron path.

5. An electron accelerator as set forth in claim 3 wherein:

a Klystron Series is positioned around said radio-frequency Linacs to create oscillating electric and magnetic fields in said radio-frequency Linacs to assist acceleration of said electrons.

6. An electron accelerator as set forth in claim 1 wherein:

said electron injector is positioned at the beginning or front end of said linear accelerator for converting said electric current into said free-electrons for acceleration in said linear accelerator.

7. An electron accelerator as set forth in claim 1 wherein:

a power control junction is positioned at the front end of said linear accelerator to control and coordinate the flow of current to and from all electrical components within said electron accelerator.

8. An electron accelerator as set forth in claim 1 wherein:

electron deflector plates are positioned at the exit from said electron accelerator for controlling the direction or vector of said electrons after they leave said electron accelerator.

9. An electron accelerator as set forth in claim 3 wherein:

said radio-frequency Linac is a series of radio-frequency modules;

said electron injector is positioned at the beginning or front end of said series of radio-frequency Linac modules for converting said electric current into free-electrons for acceleration in said radio-frequency Linacs.

10. An electron accelerator as set forth in claim 1 wherein:

a power control junction is positioned before said electron injector to control and coordinate the flow of current to and from all electrical components within said electron accelerator.

11. An electron accelerator as set forth in claim 10 wherein:

electron deflector plates are positioned at the exit from said electron accelerator for controlling the direction or vector of said electrons after they leave said electron accelerator.

12. An electron accelerator including:

an electromagnetic scoop coil for capturing free electrons;

means for maintaining said electromagnetic scoop coil positively charged;

an electron injector for providing free-electrons into an electron acceleration means.

13. An electron accelerator as set forth in claim 12 wherein:

said electron acceleration means includes a series of linear acceleration modules for accelerating said free electrons;

a quadrapole magnet is positioned between said linear acceleration modules to control and vector said electron path.

14. An electron accelerator as set forth in claim 13 wherein:

said series of linear acceleration modules are radio-frequency Linacs.

15. An electron accelerator as set forth in claim 14 including:

a Klystron series positioned around said radio-frequency Linacs to create oscillating electric and magnetic fields in said radio-frequency Linacs to assist acceleration of said electrons.

16. An electron accelerator as set forth in claim 12 including:

a thermionic fission cell for generating electricity;

said thermionic fission cell and said electromagnetic scoop coil both providing independent sources of electrons.

17. An electron accelerator as set forth in claim 12 including:

electron deflector plates at the exit from said electron accelerator for controlling the direction or vector of said free electrons after they leave said electron accelerator.

* * * * *